US010557648B2

(12) United States Patent
Naito et al.

(10) Patent No.: US 10,557,648 B2
(45) Date of Patent: Feb. 11, 2020

(54) COOLING/HEATING SWITCHING UNIT AND AIR CONDITIONER INCLUDING THE SAME

(71) Applicant: Hitachi-Johnson Controls Air Conditioning, Inc., Tokyo (JP)

(72) Inventors: Koji Naito, Tokyo (JP); Naoyuki Fushimi, Tokyo (JP); Kazumoto Urata, Tokyo (JP); Gen Yasuda, Tokyo (JP); Kazunori Fukuda, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 85 days.

(21) Appl. No.: 15/618,321

(22) Filed: Jun. 9, 2017

(65) Prior Publication Data

US 2018/0017293 A1 Jan. 18, 2018

(30) Foreign Application Priority Data

Jul. 15, 2016 (JP) ..... 2016-140742

(51) Int. Cl.
*F25B 13/00* (2006.01)
*F25B 49/02* (2006.01)

(52) U.S. Cl.
CPC ..... *F25B 13/00* (2013.01); *F25B 49/02* (2013.01); *F25B 2313/007* (2013.01);
(Continued)

(58) Field of Classification Search
CPC ..... F25B 13/00; F25B 2313/02742; F25B 2313/007; F25B 2313/0231; F25B 2500/22; F25B 2500/222; F24F 11/36; F24F 1/32
See application file for complete search history.

(56) References Cited

U.S. PATENT DOCUMENTS 5,927,093 A 7/1999 Noguchi et al.
6,147,613 A * 11/2000 Doumit ..... G01M 3/04 137/312

(Continued)

FOREIGN PATENT DOCUMENTS

DE 102015114309 A1 * 3/2017 ..... B60H 1/00885
EP 0 862 023 A2 9/1998

(Continued)

OTHER PUBLICATIONS

Uchiyama Shinji JP-2017015999-A Refrigeration Equipment (Year: 2017).*

(Continued)

*Primary Examiner* — Ljiljana V. Ciric
(74) *Attorney, Agent, or Firm* — Mattingly & Malur, PC

(57) ABSTRACT

A cooling/heating switching unit includes first to third fittings, expansion valves and expansion-valve driving sections, a housing, a heat insulating material, and a refrigerant leak detection sensor. The first and second fittings respectively connect with a high/low-pressure-gas main pipe and a low-pressure-gas main pipe, which are linked to an outdoor unit. The third fitting connects with an indoor-unit connection pipe, which is linked to indoor units. The expansion valve for high/low-pressure-gas pipe, the expansion valve for low-pressure-gas pipe, and expansion-valve driving sections selectively connect the first or second fitting with the third fitting via a refrigerant pipe to control a flow direction of refrigerant. The housing houses the refrigerant pipe. The heat insulating material fills inside of the housing to insulate the refrigerant pipe arranged inside of the housing from heat. The refrigerant leak detection sensor is installed outside of the housing to detect leaked refrigerant.

8 Claims, 6 Drawing Sheets

(52) U.S. Cl.
CPC ..... *F25B 2313/0233* (2013.01); *F25B 2313/02742* (2013.01); *F25B 2500/222* (2013.01)

(56) References Cited

U.S. PATENT DOCUMENTS

| | | | | |
|---|---|---|---|---|
| 9,523,518 | B2 * | 12/2016 | Kitamura | F25B 13/00 |
| 2005/0028547 | A1 * | 2/2005 | Hatakeyama | B60H 1/00921 62/324.1 |
| 2010/0244863 | A1 | 9/2010 | Sasaki et al. | |
| 2010/0293982 | A1 * | 11/2010 | Favier | F24D 3/10 62/324.6 |
| 2012/0292006 | A1 * | 11/2012 | Yamashita | F24F 3/06 165/200 |
| 2013/0227977 | A1 * | 9/2013 | Morimoto | F25B 13/00 62/126 |
| 2015/0292780 | A1 * | 10/2015 | Kitamura | F25B 13/00 62/324.1 |
| 2016/0109162 | A1 * | 4/2016 | Suzuki | F24F 13/20 62/498 |
| 2017/0227262 | A1 * | 8/2017 | Suzuki | F24F 11/74 |

FOREIGN PATENT DOCUMENTS

| | | | | |
|---|---|---|---|---|
| EP | 2 213 965 | A1 | | 8/2010 |
| EP | 2 535 651 | A1 | | 12/2012 |
| JP | 2015-042930 | A | | 3/2015 |
| JP | 2017015999 | A | * | 1/2017 |
| WO | 2013/038703 | A1 | | 3/2013 |
| WO | 2015/041166 | A1 | | 3/2015 |

OTHER PUBLICATIONS

Frank Schmitz, Bi-directional Electronic Expansion Device (Priority: Aug. 28, 2015) (Year: 2017).*

Extended European Search Report received in corresponding European Application No. 17180421.4 dated Apr. 19, 2018.

Communication Pursuant to Article 94(3) EPC received in corresponding European Application No. 17 180 421.4 dated May 27, 2019.

* cited by examiner

COOLING/HEATING SWITCHING UNIT AND AIR CONDITIONER INCLUDING THE SAME

CROSS-REFERENCE TO RELATED APPLICATION

This application claims the benefit of priority to Japanese Patent Application No. 2016-140742 filed 15 Jul. 2016, the disclosures of all of which are hereby incorporated by reference in their entireties.

TECHNICAL FIELD

The present invention relates to a cooling/heating switching unit used in a multi-system air conditioner for simultaneous cooling and heating, and an air conditioner that includes the cooling/heating switching unit, and more particularly, to detection of leaked refrigerant in the cooling/heating switching unit.

BACKGROUND OF THE INVENTION

Because of the influence on global warming due to refrigerant used in air conditioners, using alternative refrigerant (R32, and HFO refrigerant such as R1234yf and R1234ze) having a small global warming coefficient has been examined instead of using conventional refrigerant (R404A and R410A). In addition, a technique of detecting leaked refrigerant has been examined so that, in an air conditioner, any leak of refrigerant can quickly be detected to take action even if it happens.

With respect to a technique of detecting leaked refrigerant, a technique described in Japanese Patent Application Publication No. 2015-42930 is known. Japanese Patent Application Publication No. 2015-42930 describes an air conditioning apparatus including: an outdoor unit that includes at least a compressor and an outdoor pipe; an indoor unit that includes at least an indoor heat exchanger, an indoor blower fan, and an indoor pipe; an extension pipe that connects the outdoor pipe with the indoor pipe; a first temperature sensor that is disposed below a joining section which connects the indoor heat exchanger with the indoor pipe; and a control section that uses variation in temperature detected by the first temperature sensor while the indoor blower fan is stopped, to determine whether refrigerant having specific gravity larger than that of the indoor air has leaked from the joining section.

SUMMARY OF THE INVENTION

Problem to be Solved

In the technique described in Patent Literature 1, the leak of the refrigerant is detected by using temperature sensors set in the outdoor unit and the indoor unit (see, for example, FIGS. 3 and 4 of Patent Literature 1). However, depending on seasons and the time of day, temperatures around the temperature sensors may vary. Also, the temperature of the circulating refrigerant varies much, and then even if the refrigerant has not leaked, variation in temperature of the refrigerant could affect the temperature sensors. Therefore, it is likely that a temperature to be measured is affected by the refrigerant to indicate an inaccurate temperature. Consequently, detecting an accurate temperature may fail.

In recent years, a multi-system air conditioner for simultaneous cooling and heating attracts attention that includes an outdoor unit and two or more indoor units and allows each indoor units to independently operate cooling or heating. However, in such a multi-system air conditioner for simultaneous cooling and heating, installing a temperature sensor in each of the indoor units, as described in Patent Literature 1, causes a refrigerant leak detection flow to be complicated. That is, a flow, for example, shown in FIG. 7 of Patent Literature 1 needs to be done for each of the indoor units. Therefore, the technique described in Patent Literature 1 is not simple.

In particular, in the multi-system air conditioner for simultaneous cooling and heating, a cooling/heating switching unit (a refrigerant-channel switching unit) that controls flow directions of the refrigerant in the respective indoor units is provided between the outdoor unit and the two or more indoor units. In the cooling/heating switching unit, a large number of connections between pipes are present. Therefore, reliable detection of leak of refrigerant is desired in the vicinity of the cooling/heating switching unit.

The present invention has been devised in view of these circumstances and a problem to be solved by the present invention is to provide a cooling/heating switching unit capable of simply and reliably detecting leak of refrigerant, and an air conditioner including the cooling/heating switching unit.

Solution to Problem

As a result of earnest examinations in order to solve the problem, the inventors have reached following findings. That is, the gist of the present invention is a cooling/heating switching unit for connection with two or more use-side units and a heat-source-side unit to constitute an air conditioner capable of operating simultaneous cooling and heating, and the cooling/heating switching unit includes: a first-refrigerant-pipe fitting and a second-refrigerant-pipe fitting that have a first refrigerant pipe and a second refrigerant pipe connected thereto, respectively, wherein the first and second refrigerant pipes are linked to the heat-source-side unit; a third-refrigerant-pipe fitting that has a third refrigerant pipe connected thereto, wherein the third refrigerant pipe is linked to the use-side unit; a refrigerant-flow-direction control device that selectively connects the first-refrigerant-pipe fitting or the second-refrigerant-pipe fitting with the third-refrigerant-pipe fitting, via a refrigerant pipe, to control a flow direction of refrigerant; a housing that houses at least a part of the refrigerant pipe; a heat insulating material that fills inside of the housing to insulate the refrigerant pipe arranged inside of the housing from heat; and a refrigerant leak detection sensor that is installed outside of the housing to detect leaked refrigerant. Other aspects will be described later in Detailed Description of the Invention.

Advantageous Effect of the Invention

The present invention provides a cooling/heating switching unit capable of simply and reliably detecting leak of refrigerant, and an air conditioner including the cooling/heating switching unit.

DETAILED DESCRIPTION OF THE INVENTION

Figure 1:
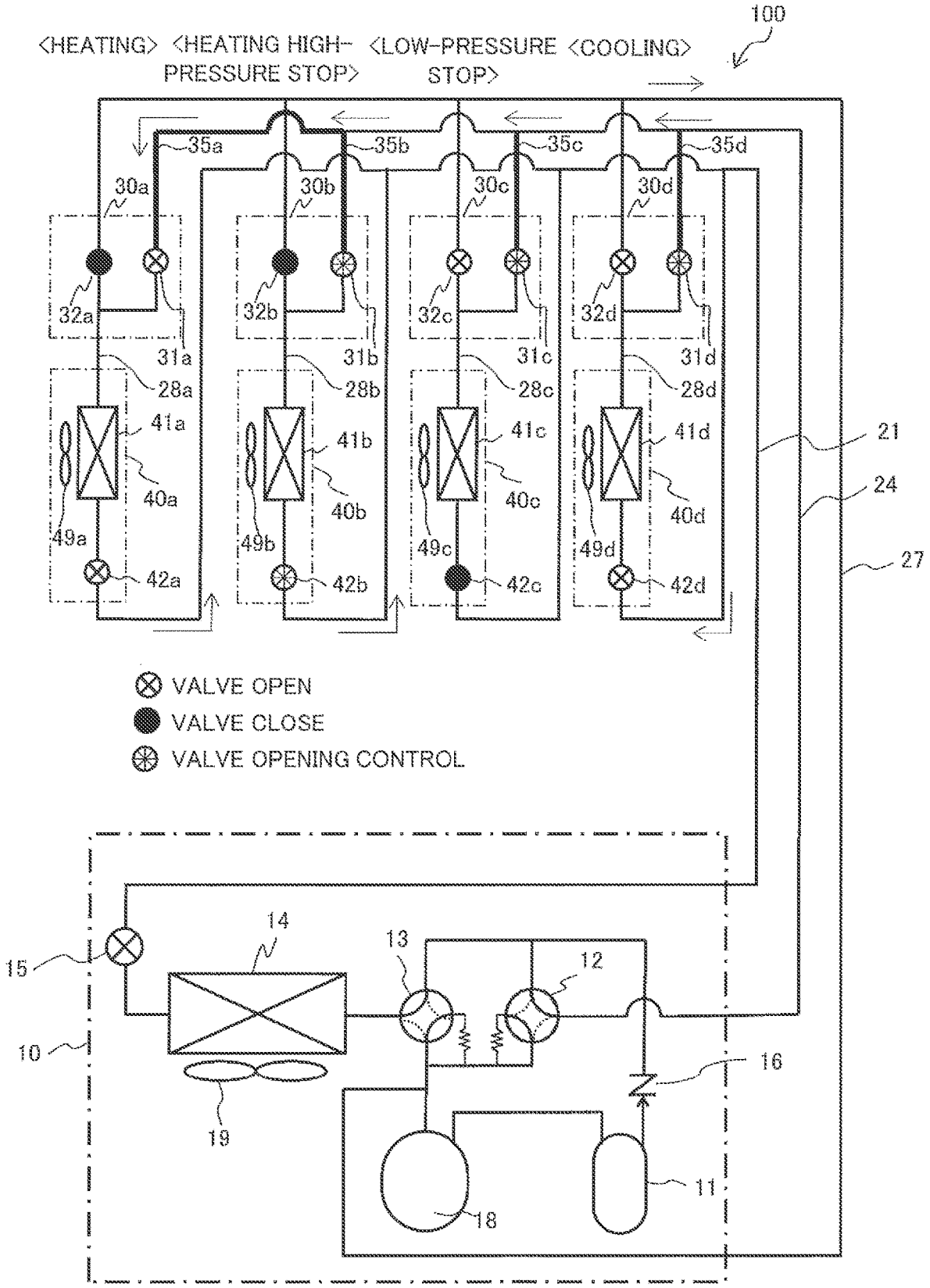
FIG. 1 is a system diagram of an air conditioner according to a present embodiment.

Hereinafter, an embodiment (the present embodiment) for carrying out the present invention will be described with reference to the drawings as appropriate. Note that, in the drawings, for the purpose of illustration, members may sometimes be omitted partly or visualized within a range of not damaging the effects of the present invention markedly.

First, an air conditioner according to the present embodiment will be described with reference to FIG. 1. Subsequently, a device configuration of a cooling/heating switching unit included in the air conditioner according to the present embodiment will be described with reference to FIG. 2 and subsequent figures.

FIG. 1 is a system diagram of an air conditioner 100 according to the present embodiment. The air conditioner is capable of independently operating cooling and heating at the same time for respective indoor units 40. In FIG. 1, for easy understanding of open or close state of each valve, expansion valves for high/low-pressure gas pipe 31*a* to 31*d* and expansion valves for low pressure gas pipe 32*a* to 32*d* are indicated by separate signs each showing an open, close, or opening control state of a valve. The air conditioner 100 includes an outdoor unit 10, the indoor units 40 (a collective term of indoor unit 40*a*, 40*b*, 40*c*, or 40*d*), and cooling/heating switching units 30 (a collective term of cooling/heating switching unit 30*a*, 30*b*, 30*c*, or a30*d*) that are located between the indoor units 40 and the outdoor unit 10. That is, the cooling/heating switching units 30 of the present embodiment are included in the air conditioner 100 of the present embodiment. A refrigeration cycle is formed between the outdoor unit 10 and the indoor units 40, to have the cooling/heating switching units 30 arranged between the outdoor unit 10 and the indoor units 40.

Note that FIG. 1 shows a configuration including four indoor units 40. However, the number of indoor units 40 is not limited to this number, and a configuration may include two or more indoor units other than four. In addition, a configuration including one outdoor unit 10 is shown. However, the number of outdoor unit 10 is not limited to this number, and a configuration may include two or more outdoor units.

The indoor units 40 are in any one of four states of heating, cooling, stop with high-pressure during heating, and stop (stop with low-pressure). The two or more indoor units 40 can operate independently from one another, with the heating and the cooling being mixed at the same time. In addition, the indoor units 40 can operate with the heating or cooling, and the stop with high-pressure during heating and/or the stop being mixed. Incidentally, FIG. 1 shows the case of mixed operation in which the indoor unit 40*a* is in the heating, the indoor unit 40*b* is in the stop with high-pressure during heating, the indoor unit 40*c* is in the stop with low-pressure, and the indoor unit 40*d* is in the cooling.

The indoor units 40 and the cooling/heating switching units 30 are connected to the outdoor unit 10 via a liquid main pipe 21, a high/low-pressure gas main pipe 24, and a low-pressure gas main pipe 27. That is, the main liquid pipe 21, the high/low-pressure gas main pipe 24, and the low-pressure gas main pipe 27 respectively branch so as to be connected to the indoor units 40 and the cooling/heating switching units 30. For example, the high/low-pressure gas main pipe 24 branches to high/low-pressure gas branch pipes 35*a*, 35*b*, 35*c*, and 35*d* (hereinafter, in the case where no distinction is required, these pipes may collectively be referred to as "high/low-pressure gas branch pipes 35") so as to be respectively connected to the cooling/heating switching units 30*a*, 30*b*, 30*c*, and 30*d*. The low-pressure gas main pipe 27 also branches halfway so as to be connected to the cooling/heating switching units 30*a*, 30*b*, 30*c*, and 30*d*. The liquid main pipe 21 also branches halfway so as to be connected to the indoor units 40*a*, 40*b*, 40*c*, and 40*d*.

The cooling/heating switching units 30 respectively include expansion valves for high/low-pressure gas pipe 31 (a collective term of the expansion valve for high/low-pressure gas pipe 31*a*, 31*b*, 31*c*, or 31*d*) and expansion valves for low-pressure gas pipe 32 (a collective term of the expansion valve for low-pressure gas pipe 32*a*, 32*b*, 32*c*, or 32*d*). The cooling/heating switching units 30 connect the indoor units 40 and the outdoor unit 10 via the high/low-pressure gas main pipe 24 and the low-pressure gas main pipe 27.

The cooling/heating switching units 30 change, through opening or closing the expansion valves for high/low-pressure gas pipe 31 and the expansion valves for low-pressure gas pipe 32, flow directions of refrigerant flowing through the indoor units 40. That is, opening or closing these valves is controlled for controlling the flow of the refrigerant flowing through refrigerant pipes constituting the cooling/heating switching units 30. Consequently, the flow directions of the refrigerant in the indoor units 40 are controlled. Specifically, opening or closing these valves allows a fitting 37 or a fitting 38 to be selectively connected with a fitting 39, via the refrigerant pipes. Consequently, the flow directions of the refrigerant are controlled. Further, controlling the flow directions of the refrigerant through the open-close operation is coordinated with decompression throttling of indoor-unit expansion valves 42 (a collective term of indoor-unit expansion valve 42*a*, 42*b*, 42*c*, or 42*d*) to switch between evaporator operation and condenser operation of indoor-unit heat exchangers 41 (a collective term of indoor-unit heat exchanger 41*a*, 41*b*, 41*c*, or 41*d*).

The indoor units 40 include the indoor-unit heat exchangers 41 (the collective term of the indoor-unit heat exchangers 41*a*, 41*b*, 41*c*, and 41*d*), the indoor-unit expansion valves 42 (the collective term of the indoor-unit expansion valve 42*a*, 42*b*, 42*c*, and 42*d*), and indoor unit fans 49 (a collective term of indoor unit fan 49*a*, 49*b*, 49*c*, and 49*d*). One end of the indoor-unit heat exchanger 41 is connected to the liquid main pipe 21 via the indoor-unit expansion valve 42. The other end of the indoor-unit heat exchanger 41 is connected to the cooling/heating switching unit 30 via an indoor-unit connection pipe 28 (a collective term of indoor-unit connection pipe 28*a*, 28*b*, 28*c*, or 28*d*).

In the air conditioner 100, the liquid main pipe 21 is not directly connected to the cooling/heating switching units 30. Further, gas-liquid separation tanks are not disposed inside the cooling/heating switching units 30. Accordingly, even if refrigerant leaks inside the cooling/heating switching units 30 and/or fittings of the pipes, only gas refrigerant leaks. Therefore, a leak amount of the refrigerant is small to reduce sources of global warming as much as possible.

A description will be given of the flow of the refrigerant in the outdoor unit 10. The outdoor unit 10 includes a compressor 11, a four-way high/low-pressure-gas-pipe valve 12, a four-way heat-exchanger valve 13, an outdoor-unit heat exchanger 14, an outdoor-unit expansion valve 15, an outdoor unit fan 19, and an accumulator 18. Among these components, the accumulator 18 separates liquid refrigerant which may be mixed during transition to deliver gas refrigerant to the compressor 11. The compressor 11 connects to the accumulator 18 at a low-pressure. The compressor 11 connects to the four-way valves (the four-way high/low-pressure-gas-pipe valve 12 and the four-way heat-exchanger valve 13) at a high-pressure. This pressure difference of the compressor 11 causes the refrigerant to be conveyed.

A description will be given of the four-way high/low-pressure-gas-pipe valve 12 and the four-way heat-exchanger valve 13. The four-way high/low-pressure-gas-pipe valve 12 switches between connection of the high/low-pressure gas main pipe 24 to the compressor 11 on its discharge side and connection of the high/low-pressure gas main pipe 24 to the accumulator 18 on its suction side. For example, when any one of the indoor units 40 operates heating, the four-way high/low-pressure-gas-pipe valve 12 is switched to connect the high/low-pressure gas main pipe 24 to the compressor 11 on its discharge side. Consequently, gas refrigerant having high-temperature and high-pressure is supplied to the high/low-pressure gas main pipe 24.

The four-way heat exchanger valve 13 switches between connection of the outdoor-unit heat exchanger 14 to the compressor 11 on its discharge side and connection of the outdoor-unit heat exchanger 14 to the accumulator 18 on its suction side. For example, if the outdoor-unit heat exchanger 14 is used as a condenser, the four-way heat-exchanger valve 13 is switched to connect the outdoor-unit heat exchanger 14 to the compressor 11 on its discharge side. Alternatively, if the outdoor-unit heat exchanger 14 is used as an evaporator, the four-way heat-exchanger valve 13 is switched to connect the outdoor-unit heat exchanger 14 to the accumulator 18 on its suction side.

The connection is switched by the four-way heat-exchanger valve 13 according to a condition of a heating load and a cooling load of the air conditioner. Specifically, if the heating load of the air conditioner 100 is larger than the cooling load, the four-way heat-exchanger valve 13 is switched to connect the outdoor-unit heat exchanger 14 to the accumulator 18 on its suction side. At the same time, the outdoor-unit expansion valve 15 is throttled so as to be decompressed. According to these kinds of control, the outdoor-unit heat exchanger 14 acts as the evaporator to continue stable operation. On the contrary, if the cooling load of the air conditioner 100 is larger than the heating load, the four-way heat-exchanger valve 13 is switched to connect the outdoor-unit heat exchanger 14 to the compressor 11 on its discharge side. At the same time, the outdoor-unit expansion valve 15 is opened. According to these kinds of control, the outdoor-unit heat exchanger 14 acts as the condenser to continue stable operation.

A description will be given of the flow of refrigerant in the indoor unit 40. Here, the indoor unit 40*a* will be taken as the exemplary indoor unit 40 in heating operation. Gas refrigerant having high-temperature and high-pressure compressed by the compressor 11 is conveyed to the high/low-pressure gas main pipe 24 via the four-way high/low-pressure-gas-pipe valve 12. At this time, the expansion valve for low-pressure gas pipe 32*a* of the cooling/heating switching unit 30*a* is closed to inhibit communication between the low-pressure gas main pipe 27 and the indoor-unit heat exchanger 41*a*. The expansion valve for high/low-pressure gas pipe 31*a* is opened to flow refrigerant from the high/low-pressure gas main pipe 24 to the indoor-unit heat exchanger 41*a*. Consequently, gas refrigerant having high-temperature and high-pressure flowing through the high/low-pressure gas main pipe 24 is supplied to the indoor-unit heat exchanger 41*a*. Then, the indoor-unit heat exchanger 41*a* acts as the condenser for heating operation through heat of condensation of gas refrigerant having high-temperature and high-pressure. Condensed high-pressure liquid refrigerant or gas-liquid two-phase refrigerant flows through the indoor-unit expansion valve 42 in an open state to the liquid main pipe 21.

Next, the indoor unit 40*d* will be taken as the exemplary indoor unit 40 in cooling operation to describe the flow of refrigerant in the indoor unit 40. Refrigerant is supplied from two supply sources to the indoor unit 40 in cooling operation. First refrigerant is high-pressure liquid refrigerant or gas-liquid two-phase refrigerant discharged from the outdoor-unit heat exchanger 14 operating as the condenser. Second refrigerant is condensed refrigerant from the indoor unit 40*a* in heating operation. Among these, the former refrigerant flows through the liquid main pipe 21 to the indoor unit 40*d*. As for the latter refrigerant, refrigerant discharged from the indoor-unit heat exchanger 41*a* operating as the condenser flows through the indoor-unit expansion valve 42*a* in an open state to the indoor unit 40*d*.

The indoor-unit expansion valve 42*d* of the indoor unit 40*d* in cooling operation has its opening adjusted to serve as a throttle valve for decompressing refrigerant. The refrigerant decompressed by the indoor-unit expansion valve 42*d* evaporates in the indoor-unit heat exchanger 41*d* operating as the evaporator, so as to be vaporized into low-pressure gas refrigerant. Heat of vaporization of refrigerant at this time is used for cooling operation. The vaporized low-pressure gas refrigerant is conveyed to the low-pressure-gas main pipe 27 through the opened expansion valve for low-pressure gas pipe 32*d* of the cooling/heating switching unit 30*d*. Since the low-pressure-gas main pipe 27 is connected to the outdoor unit 10, the gas refrigerant returns to the compressor 11 through the accumulator 18. Then, the gas refrigerant is compressed again by the compressor 11 for circulation.

Note that the operation of the air conditioner 100 is controlled by an arithmetic control section, not shown. The arithmetic control section includes a CPU (Central Processing Unit), a RAM (Random Access Memory), a ROM (Read Only Memory), and an I/F (interface), all of which are not shown in the figure. A predetermined control program stored in the ROM is executed by the CPU to embody the arithmetic control section.

Figure 2A:
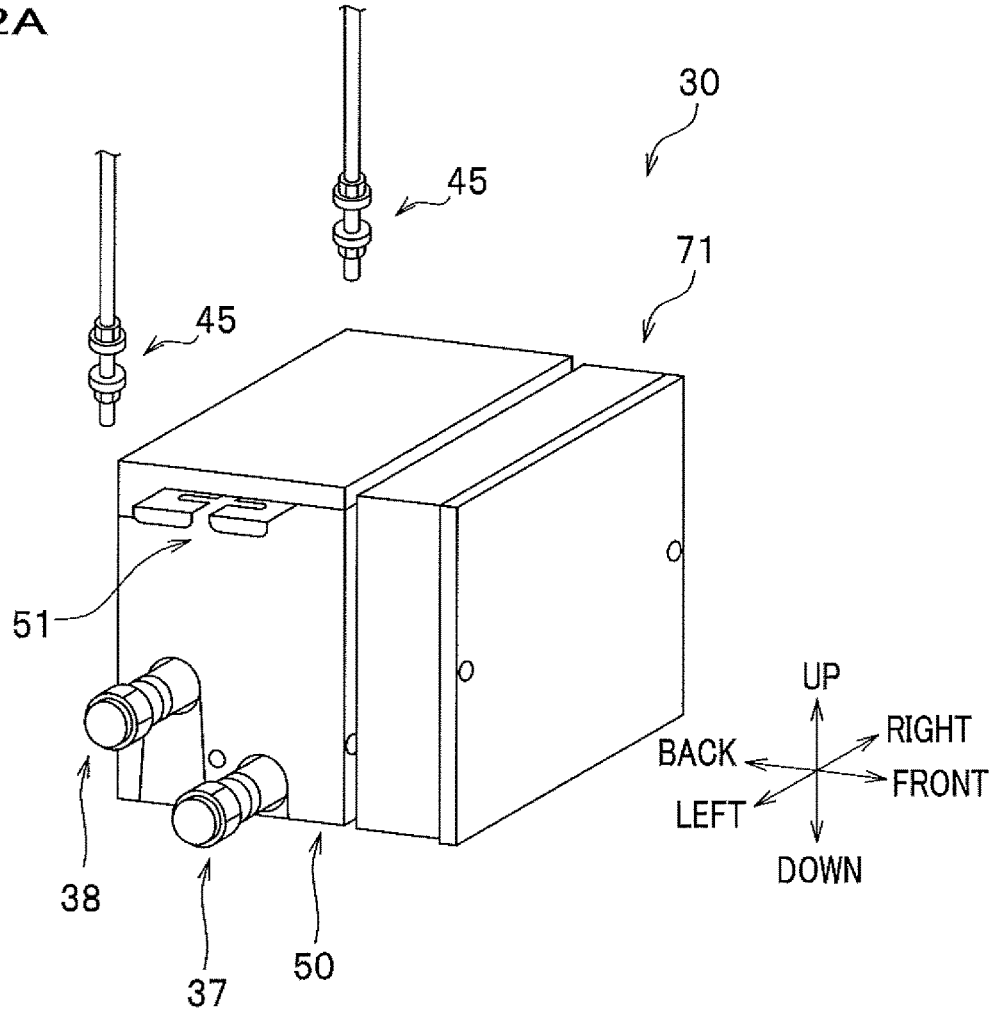
FIG. 2A is an exterior perspective view of a cooling/heating switching unit according to the present embodiment.
Figure 2B:
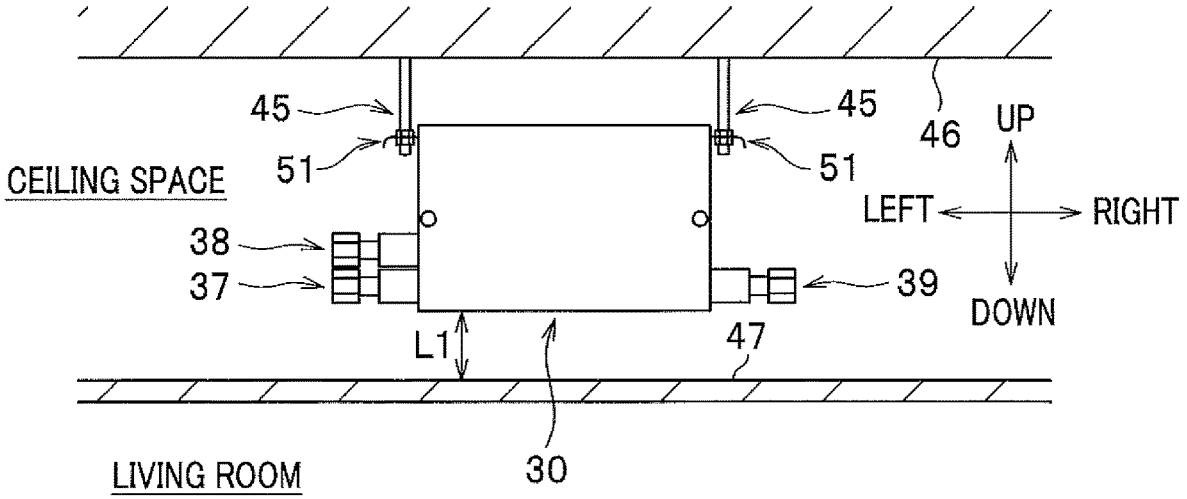
FIG. 2B is a diagram of the cooling/heating switching unit according to the present embodiment installed at a designated point.

FIG. 2A is an exterior perspective view of the cooling/heating switching unit 30 of the present embodiment and FIG. 2B is a diagram of the cooling/heating switching unit 30 of the present embodiment installed at a designated point. A detailed configuration will be described later. The cooling/heating switching unit 30 includes, as shown in FIG. 2A, a housing 50 that houses pipes, heat insulating materials, and valves (neither is shown here) and an electrical box 71 that houses a circuit board 73 to which refrigerant leak detection sensors 81 to be described later (not shown here; details will be described later) are connected. Note that the refrigerant leak detection sensor 81 is a sensor for detecting refrigerant leaked in the cooling/heating switching unit 30.

A hooking section 51 is attached to the upper outer side surface of the housing 50. However, in FIG. 2A, a hooking section attached to the right side surface is not shown. The hooking section 51 can be hooked to a ceiling fitting 45 extending downward from an upper boundary surface of ceiling space 46 (see FIG. 2B). Therefore, as will be described later in detail with reference to FIG. 2B, the cooling/heating switching unit 30 can be supported from the upper boundary surface of ceiling space 46 so as to be installed in a ceiling space.

As shown in FIG. 1, the cooling/heating switching unit 30 is installed between the indoor unit 40 and the outdoor unit 10. Specifically, for example, the cooling/heating switching unit 30 can be installed near the indoor unit 40 in a ceiling space above a living room in which the indoor unit 40 is installed. Such an installation is shown in FIG. 2B.

As shown in FIG. 2B, the cooling/heating switching unit 30 is supported by and fixed to two ceiling fittings 45 extending downward from the upper boundary surface of ceiling space 46. After the supporting and fixing are completed, the pipes to be connected to the indoor units 40 and the outdoor unit 10 are connected onsite to the cooling/heating switching unit 30. Note that this connection is flare connection as will be described later in detail. As for an installation point in the height direction of the cooling/heating switching unit 30, the cooling/heating switching unit 30 is preferably installed so as to have a distance L1 of 50 mm or more, for example, which is the distance from the upper surface of a dropped-ceiling plate 47 to the bottom surface of the cooling/heating switching unit 30, considering such as easy maintenance and service space. For further facilitation, the distance L1 is preferably set to 70 mm or more.

Figure 3:
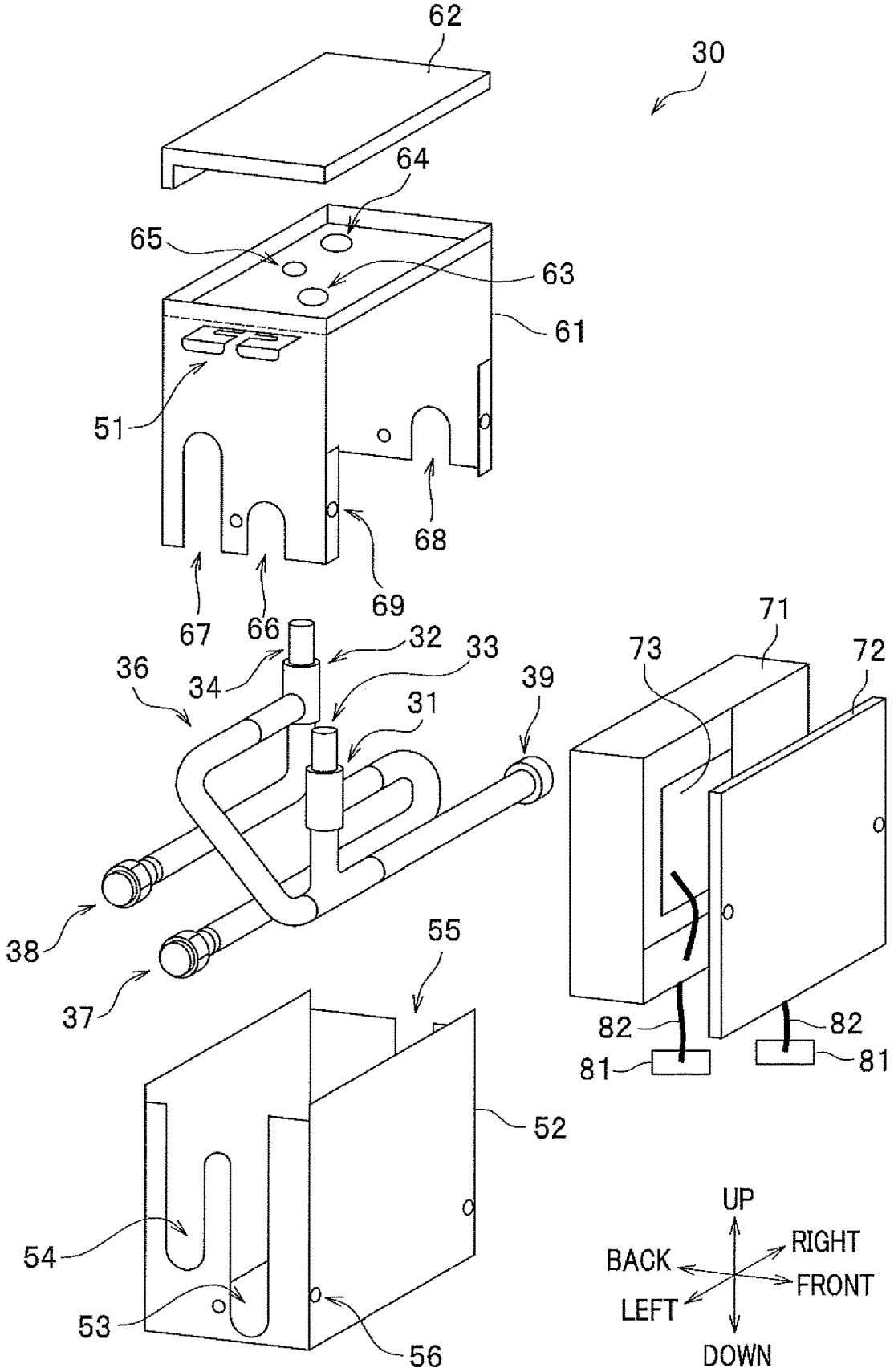
FIG. 3 is an exploded perspective view of the cooling/heating switching unit according to the present embodiment.

FIG. 3 is an exploded perspective view of the cooling/heating switching unit 30 of the present embodiment. The cooling/heating switching unit 30 includes an upper lid 62, an upper sheet metal 61 in a box shape having no bottom surface and no side surfaces in a front-back direction, a cyclic cooling/heating-switching-unit part 36, a lower sheet metal 52 in a box shape having no upper surface, and the electrical box 71 attached to the front side of the lower sheet metal 52. Among these components, the upper sheet metal 61 is formed to have notches 66, 67, 68 on the right and left side surfaces thereof for fitting pipes constituting the cyclic cooling/heating-switching-unit part 36, as will be described later in detail. Additionally, the lower sheet metal 52 is formed to have notches 53, 54, 55 on the right and left side surfaces thereof for fitting the above-identified pipes, as will be described later in detail. The upper sheet metal 61 and the lower sheet metal 52 are combined so as to overlap each other, to form the housing 50 in a box shape (see FIG. 2A). After the combining, screws (not shown) are inserted into screw holes 56 of the lower sheet metal 52 and screw holes 69 of the upper sheet metal 61 from inside of the electrical box 71 to support and fix the electrical box 71.

The housing 50 houses the cyclic cooling/heating-switching-unit part 36 that controls a refrigerant flow channel to switch between cooling and heating operation of the indoor unit 40 (not shown in FIG. 3). The upper sheet metal 61 and the lower sheet metal 52 are configured so that two pipes extending leftward and one pipe extending rightward, which constitute the cyclic cooling/heating-switching-unit part 36, project outward from the housing 50, at the time of combining the upper sheet metal 61 and the lower sheet metal 52 so as to overlap each other.

Specifically, in FIG. 3, a pipe disposed in the lower left side so as to extend leftward fits in the notch 53 formed on the left side surface of the lower sheet metal 52, and the notch 66 formed on the left side surface of the upper sheet metal 61. In addition, a pipe disposed in the lower left side so as to extend leftward fits in the notch 54 formed on the left side surface of the lower sheet metal 52, and the notch 67 formed on the left side surface of the upper sheet metal 61. Further, a pipe disposed so as to extend rightward fits in the notch 55 formed on the right side surface of the lower sheet metal 52, and the notch 68 formed on the right side surface of the upper sheet metal 61.

The cyclic cooling/heating-switching-unit part 36 includes the expansion valve for high/low-pressure gas pipe 31 and the expansion valve for low-pressure gas pipe 32 as illustrated in FIG. 1. Expansion-valve driving sections 33 and 34 for controlling opening and closing of these valves are disposed so as to be exposed outside of the upper sheet metal 61 through expansion-valve through-holes 63 and 64 formed on the upper surface of the upper sheet metal 61. Therefore, as will be described later in detail, a foaming agent is filled inside of the housing that houses the cyclic cooling/heating-switching-unit part 36, but the foaming agent is prevented from contacting the expansion-valve driving sections 33 and 34. This allows for detaching and reattaching, such as at the time of maintenance, expansion valve coils (not shown) linked onto the expansion-valve driving sections 33 and 34. Incidentally, the upper lid 62 is attached above the expansion valve coils projecting outward so as to cover the expansion valve coils.

The cyclic cooling/heating-switching-unit part 36 is connected with the high/low-pressure gas main pipe 24, the low-pressure gas main pipe 27, and the indoor-unit connection pipe 28 (see FIG. 1 also for the connected pipes). Specifically, in FIG. 3, the high/low-pressure gas main pipe 24 is connected to the fitting 37 of a pipe disposed on the lower left side so as to extend leftward. In addition, the low-pressure gas main pipe 27 is connected to the fitting 38 of a pipe disposed on the upper left side so as to extend leftward. Further, the indoor-unit connection pipe 28 is connected to the fitting 39 of a pipe disposed so as to extend rightward. All of the fittings 37, 38, and 39 are eligible for flare connection. Therefore, the high/low-pressure gas main pipe 24, the low-pressure gas main pipe 27, and the indoor-unit connection pipe 28 are flare-connected to the fittings 37, 38, and 39 constituting the cooling/heating switching unit 30, to connect the high/low-pressure gas main pie 24, the low-pressure gas main pipe 27, and the indoor-unit connection pipe 28 to the cooling/heating switching unit 30.

Figure 4:
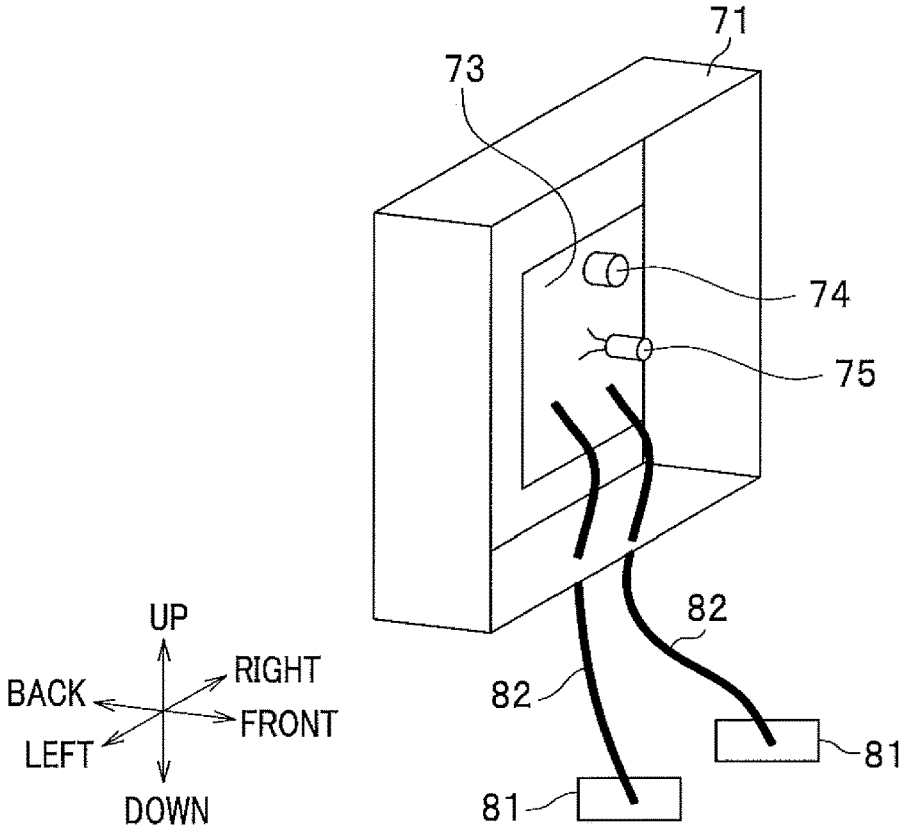
FIG. 4 is a diagram showing the internal structure of an electrical box included in the cooling/heating switching unit according to the present embodiment.

FIG. 4 is a diagram showing the internal structure of the electrical box 71 included in the cooling/heating switching unit 30 of the present embodiment. The electrical box 71 includes an electrical box lid 72 and the circuit board 73 including a buzzer 74 and an LED 75. Note that the circuit board 73 is connected to a power supply (not shown) for driving the refrigerant leak detection sensors 81. The electrical box lid 72 (see FIG. 3) is closed after the circuit board 73 is housed inside of the electrical box 71 in a box shape, to finish configuring the electrical box 71.

The refrigerant leak detection sensors 81 for detecting leaked refrigerant are connected to the circuit board 73 via wires 82. The cooling/heating switching unit 30 of the present embodiment includes two refrigerant leak detection sensors 81. Both of the wires 82 connected to the refrigerant leak detection sensors 81 have a length of allowing the refrigerant leak detection sensors 81 to be freely moved to some extent (in the present embodiment, a length of allowing the refrigerant leak detection sensors 81 to be moved to a point below the housing 50). Therefore, during transportation of the cooling/heating switching unit 30, the refrigerant leak detection sensors 81 are fixed to the surface of the electrical box 71 such as by magnets or housed inside of the electrical box 71 by bundling the wires 82. After fixing the cooling/heating switching unit 30, the refrigerant leak detection sensors 81 are detached from a main body of the housing 50 so as to be separated from the housing 50 for arrangement at designated points.

As shown in FIG. 2, for example, the cooling/heating switching unit 30 may be installed at a point, such as in a ceiling space, which is usually invisible. Therefore, the cooling/heating switching unit 30 is configured to make the LED 75 flash and to make the buzzer 74 buzz, when leak of refrigerant is detected by the refrigerant leak detection sensors 81. At the same time, identification information for identifying the cooling/heating switching unit 30 having leak is transmitted to a centralized management device (not shown), which is capable of centrally managing the outdoor unit 10 and the indoor units 40. The transmission is made by a transmission unit (not shown) mounted on the circuit board 73 through an electric signal line that connects the circuit board 73 with the centralized management device.

The buzzer 74 buzzes to notify people around the cooling/heating switching unit 30 of leak of refrigerant. In addition, the LED 75 flashes to allow an administrator to visually recognize, at the time of visiting onsite to check the cooling/heating switching unit 30 and seeing inside of the electrical box 71, that the cooling/heating switching unit 30 being checked is the one having leak of refrigerant.

Identification information to be notified to the centralized management device may be, for example, positional information such as a floor number, a location on a floor having the floor number, and a location of a living room closest to the cooling/heating switching unit 30, or alternatively, a specific number or the like given in advance to each cooling/heating switching unit 30. Among these kinds of information, if the specific number is notified, the location of the cooling/heating switching unit 30 having leak of refrigerant is identified, on the basis of a mapping table preliminarily stored in the centralized management device in which specific numbers are associated with locations of the cooling/heating switching units 30, respectively. Note that these kinds of identification information is preferably input and stored in the circuit board 73 included in the cooling/heating switching unit 30 or the centralized management device AFTER actual installation of the cooling/heating switching units 30 by a constructor. However, the identification information may be given in advance BEFORE installation on the basis of a blueprint.

Referring back to FIG. 3, the foaming agent is filled inside of the housing 50 which is formed by combining the lower sheet metal 52 and the upper sheet metal 61 (not shown in FIG. 3), as described above. The foaming agent acts as a heat insulating material through hardening and is, for example, a foaming urethane agent. Therefore, the cyclic cooling/heating-switching-unit part 36 disposed inside of the housing 50 is insulated from heat by the heat insulating material.

In the cyclic cooling/heating-switching-unit part 36 during cooling operation, a piping temperature drops because low-temperature gas refrigerant coolant passes therein. Therefore, depending on air conditions in a ceiling space, moisture condensation may occur on the pipe surfaces if humidity is high, to have drops of water. In order to avoid this condition, the pipes (including the cyclic cooling/heating-switching-unit part 36) constituting the air conditioner 100 are insulated from heat. However, connections of the pipes constituting the cyclic cooling/heating-switching-unit part 36 are complicated to make heat insulation by a normal heat insulation material difficult. Therefore, in the cooling/heating switching unit 30 of the present embodiment, a foaming agent is used to fill inside of the housing 50 and then hardened to arrange a heat insulation material, by taking work efficiency and heat insulation efficiency into account. This allows for finishing work earlier than individually winding the heat insulating material on the pipes. In addition, voids are less likely formed in the arranged heating insulating material, to improve heat insulation efficiency. Note that the foaming agent is injected into the housing 50 through a foaming-agent injection hole 65 formed on the upper surface of the upper sheet metal 61.

As noted above while describing the cyclic cooling/heating-switching-unit part 36, the fittings 37, 38, and 39 are all flare-connected, which are the ends of the pipes constituting the cyclic cooling/heating-switching-unit part 36. The flare connection is a technique of forging a connection pipe (e.g., made of copper) at an end so as to flare out and then cramping the end between a nut and a tapered fitting for sealing. With this technique, pipes are easily connected by cold working. However, if a forged portion is too short or has scratches on the surface thereof, refrigerant may likely leak. Therefore, in the cooling/heating switching unit 30, those portions of the cyclic cooling/heating switching unit part 36 particularly having possible leak of refrigeration may be the fittings 37, 38, and 39 which are flare-connected. Incidentally, since all of the fittings 37, 38, and 39 are located outside of the housing 50, refrigerant leaking from the fittings 37, 38, and 39 directly flows downward below the housing 50.

Besides these portions, other portions of the cyclic cooling/heating-switching unit part 36 having possible leak of refrigerant may be pipe joining sections such as bent portions, for example. As shown in FIG. 3, the cyclic cooling/heating-switching-unit part 36 is formed to have complicated piping, for example, with straight pipes, bent pipes, and the like. The pipes are joined, for example, by brazing. If the pipes are made of copper, for example, brazing metal is poured for joining the pipes with each other at a temperature of the copper material not melting. However, if the brazing metal is poorly poured, refrigerant may also leak from the joined portions. Here, a description will be given of how refrigerant leaked from the joined portions flows outside of the cooling/heating switching unit 36, with reference to FIG. 5.

Figure 5:
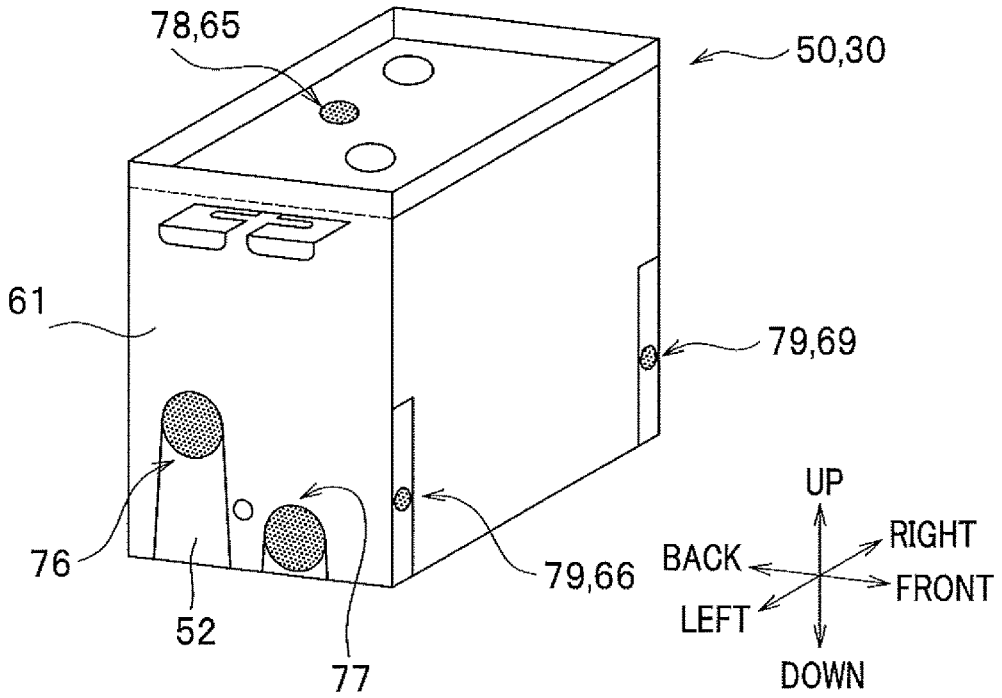
FIG. 5 is a diagram showing spots where refrigerant leaked inside of the cooling/heating switching unit 30 according to the present embodiment likely flows out when it happens.

FIG. 5 is a diagram showing spots where refrigerant leaked inside of the cooling/heating switching unit 30 (specifically, the housing 50) of the present embodiment likely flows out when it happens. Note that, in FIG. 5, pipes, screws, and the like are not shown for the purpose of simplification. In addition, FIG. 5 is used to describe, in particular, leak from the joined portions between the pipes housed inside of the housing 50, and then only the housing 50 is shown for convenience. As described above, the heat insulation material is arranged inside of the housing 50 that constitutes the cooling/heating switching unit 30. Therefore, if refrigerant leaks within the housing 50 from the joined portions between the pipes, the leaked refrigerant may flow outside through the voids of the heat insulation material.

Specifically, in FIG. 5, the leaked refrigerant may flow outside through regions 76, 77, 78, and 79 (actually gaps between the housing 50 and the pipes, in the case of the regions 76, 77, for example) which communicate the inside and the outside of the housing 50 and through which the heat insulation material inside of the housing 50 are visible. Note that, although not shown in FIG. 5, refrigerant may likely flow out also through a region on the right side-surface formed of a gap between the pipe, and the lower housing 52 or the upper housing 61. Therefore, the refrigerant leak detection sensors 81 may preferably be arranged in the vicinities of the regions 76, 77, 78, and 79.

Among these regions, refrigerant may more likely flow out from the regions 76 and 77 and the region on the right side-surface (not shown in FIG. 5) which have particularly large areas. Therefore, the refrigerant leak detection sensors 81 are provided outside of the cooling/heating switching unit 30 to detect refrigerant which has leaked inside of the housing 50 and has flown outside.

Here, since refrigerant is heavier than the air, refrigerant leaked outside of the housing 50 flows downward. Therefore, the refrigerant leak detection sensors 81 may be installed outside of the cooling/heating switching unit 30, preferably below the above-described regions, for more reliable detection. In addition, as described above, refrigerant may particularly leak at the fittings 37, 38, and 39. Therefore, the refrigerant leak detection sensors 81 may as well be installed below the fittings 37, 38, and 39. In view of these points, a description will be given of detailed installation points of the refrigerant leak detection sensors 81 with reference to FIGS. 6 and 7.

Figure 6:
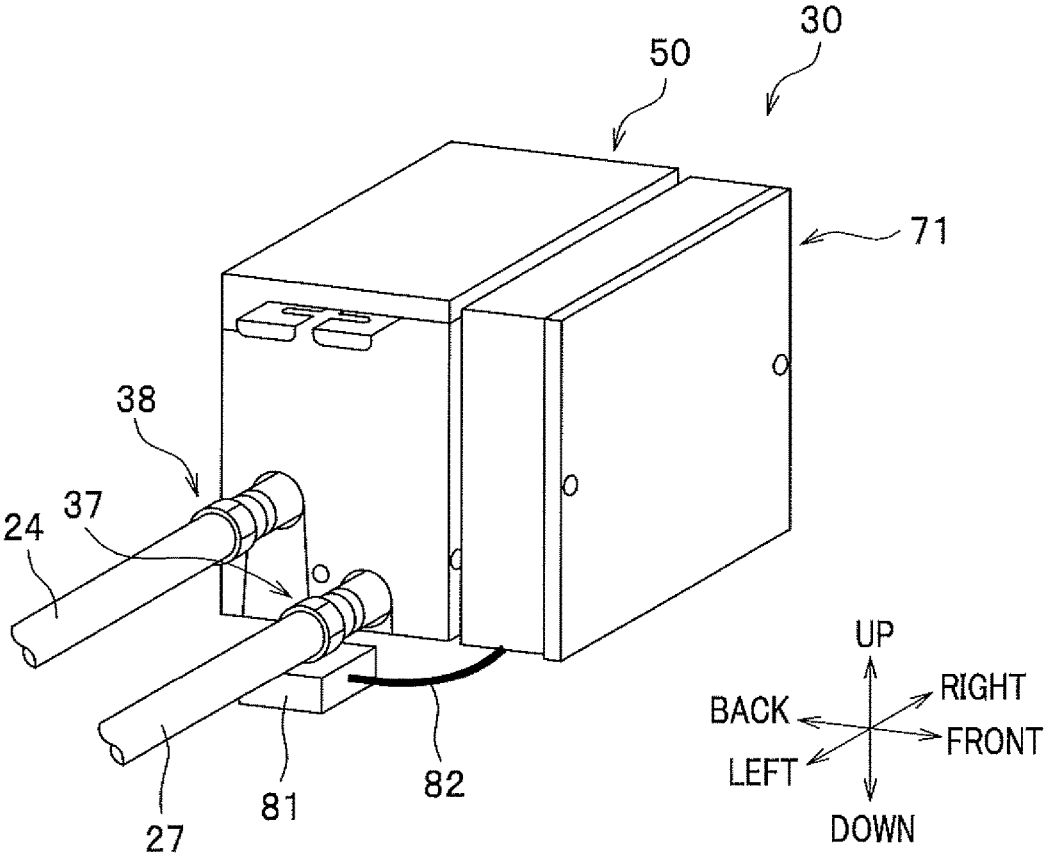
FIG. 6 is a diagram showing an installation point of a refrigerant leak detection sensor.

FIG. 6 is a diagram showing an installation point of the refrigerant leak detection sensors 81. Note that, in FIG. 6, the ceiling, the ceiling fittings 45, and the like are not shown for the purpose of simplified illustration. As described above, the refrigerant leak detection sensors 81 are preferably installed outside of the housing 50, below the fittings 37, 38, and 39. However, the fittings 37 and 38 are close to each other. Therefore, one refrigerant leak detection sensor 81 may be installed right under either one of the fittings 37 and 38, so as to reduce an equipment cost.

Figure 7:
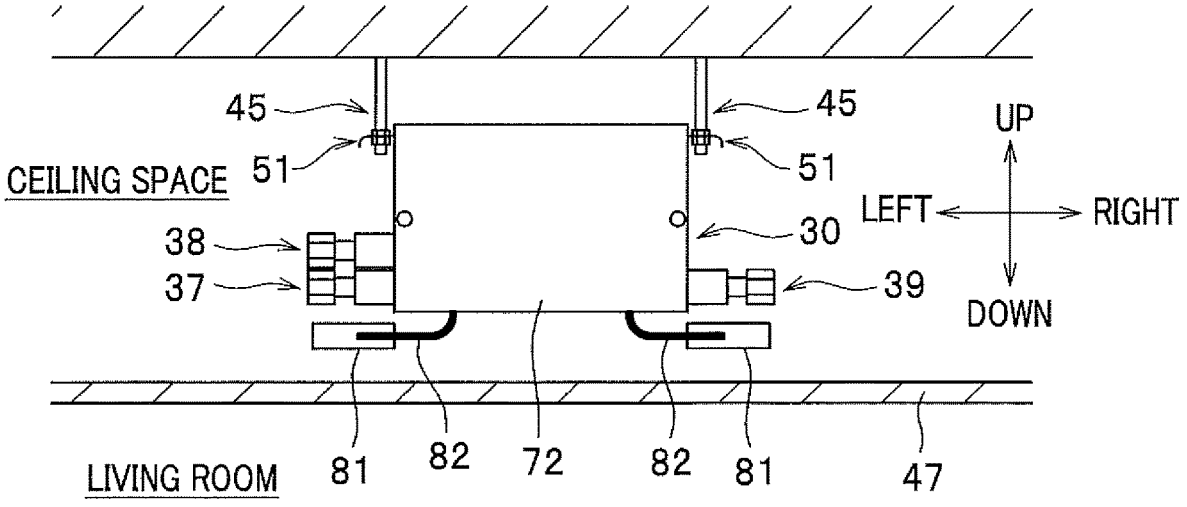
FIG. 7 is a side view of the refrigerant leak detection sensors installed as shown in FIG. 6.

FIG. 7 is a side view of the refrigerant leak detection sensors 81 installed as in FIG. 6. Note that, in FIG. 7, the housing 50 is disposed in the back as viewed from the electrical box 71 (not shown in FIG. 7) and the electrical box lid 72, and therefore the housing 50 is not shown. As shown in above-referenced FIG. 6, one refrigerant leak detection sensor 81 is installed below the fittings 37 and 38 arranged on the left. In addition, one refrigerant leak detection sensor 81 is installed below the fitting 39 arranged on the right. Note that the refrigerant leak detection sensors 81 are supported by and fixed to a lower portion of the housing 50 via supporting members, which are not shown in FIG. 7.

The refrigerant leak detection sensors 81 are respectively installed on the lower left and on the lower right to reliably detect either refrigerant leaked from the fittings 37 and 38 or refrigerant leaked from the fitting 39. Additionally, the regions 76, 77, and 79 as described with reference to FIG. 5 are located in the vicinities of the fittings 37, 38, and 39, to allow the above-identified sensors to also detect refrigerant flown outside through the regions.

Further, refrigerant leaked from the region 78 located higher as shown in FIG. 5 may flow downward along the outer wall of the housing 50. Then, installing the refrigerant leak detection sensors 81 below the fittings 37, 38, and 39, which are arranged so as to project outward from the housing 50, allows for also detecting refrigerant which has flown downward along the outer wall of the housing 50 in this way.

Figure 8:
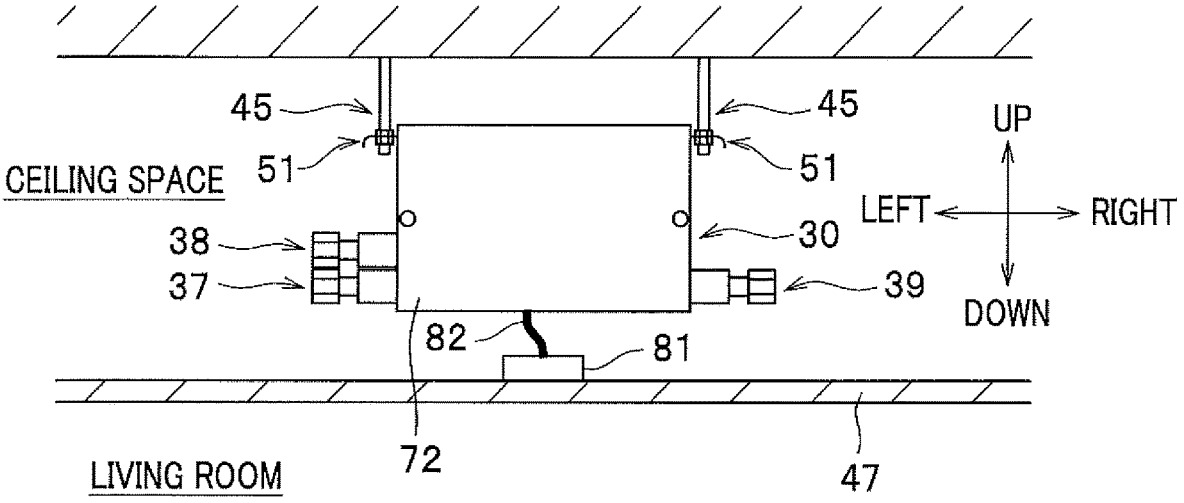
FIG. 8 is a diagram showing another installation point of the refrigerant leak detection sensor.

FIG. 8 is a diagram showing another installation point of the refrigerant leak detection sensor 81. Note that, also in FIG. 8, the housing 50 is disposed in the back as viewed from the electrical box 71 (not shown in FIG. 8) and the electrical box lid 72, and therefore the housing 50 is not shown. In FIG. 8, unlike the configuration in above-referenced FIG. 7, the refrigerant leak detection sensor 81 is installed below the cooling/heating switching unit 30 in the vicinity of the center in the right-left direction, rather than right below the fittings 37, 38, and 39. Note that, although not shown in FIG. 8, the refrigerant leak detection sensor 81 is installed also in the vicinity of the center in the front-back direction. Therefore, the refrigerant leak detection sensor 81 is installed below the vicinity of the center of the bottom surface of the cooling/heating switching unit 30. The refrigerant leak detection sensor 81 is fixed to the surface of the ceiling plate 47 that partitions the ceiling space and the living room.

Since the refrigerant is heavier than the air as described above, leaked refrigerant flows downward. Accordingly, the leaked refrigerant reaches the surface of the ceiling plate 47, and then spreads in the right-left direction in the figure to accumulate. Therefore, installing one refrigerant leak detection sensor 81 below the vicinity of the center of the cooling/heating switching unit 30 on the surface of the ceiling plate 47 allows for quickly detecting refrigerant which has flown from above.

Note that the wire 82, which connects the refrigerant leak detection sensor 81 installed on the ceiling plate 47 with the circuit board 73 (see FIG. 4) housed in the electrical box 71, preferably has a length of allowing the refrigerant leak detection sensor 81 to be fixed to the ceiling plate 47. Specifically, the length of the wire 82 is preferably longer than the length L1 described with reference to FIG. 2B. More specifically, if the length of service space (equivalent to the length L1 in FIG. 2B) is 50 mm, for example, the length of the wire 82 is preferably equal to or longer than a length obtained by adding 50 mm to the distance from the circuit board 73 to the bottom surface of the housing 50.

Figure 9:
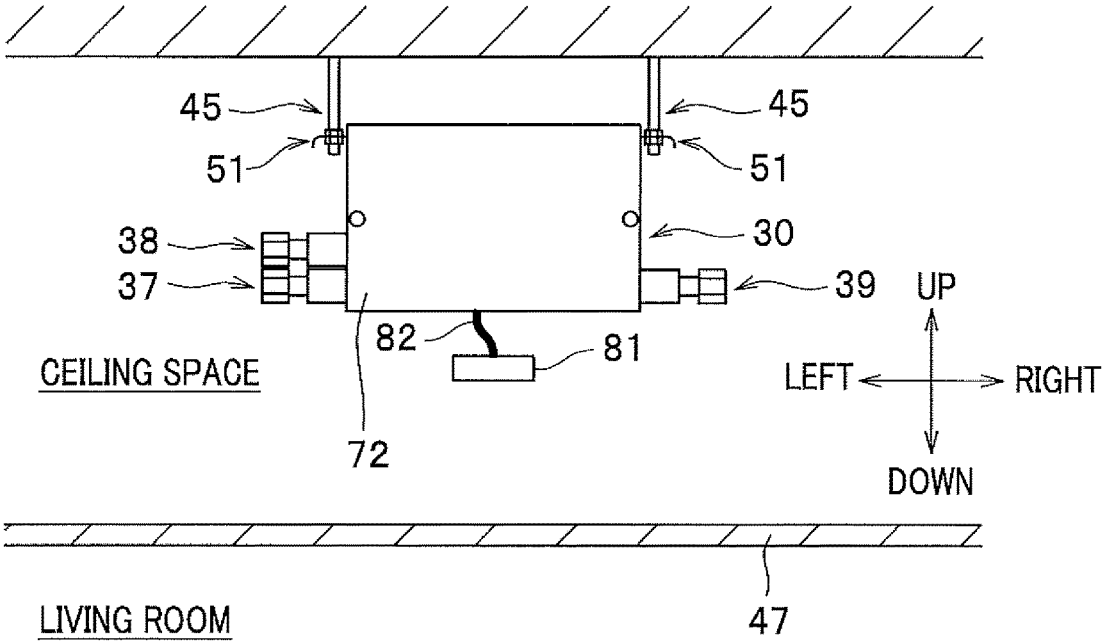
FIG. 9 is a diagram showing still another installation point of the refrigerant leak detection sensor.

FIG. 9 is a diagram showing still another installation point of the refrigerant leak detection sensor 81. Note that, also in FIG. 9, the housing 50 is disposed in the back as viewed from the electrical box 71 (not shown in FIG. 9) and the electrical box lid 72, and therefore the housing 50 is not shown. If the cooling/heating switching unit 30 and the ceiling plate 47 are excessively apart from each other, the refrigerant leak detection sensor 81 does not have to be fixed to the ceiling plate 47. That is, for example, as shown in FIG. 9, the refrigerant leak detection sensor 81 may be installed below the cooling/heating switching unit 30 in the vicinity of the center in the right-left direction. Note that, although not shown in FIG. 9, the refrigerant leak detection sensor 81 is installed also in the vicinity of the center in the front-back direction. Therefore, in the example shown in FIG. 9, the refrigerant leak detection sensor 81 is installed below the vicinity of the center of the bottom surface of the cooling/heating switching unit 30.

As described above, refrigerant leaked outside of the cooling/heating switching unit 30 flows thereunder. Then, installing the refrigerant leak detection sensor 81 at this point also allows for detecting leaked refrigerant. Note that the refrigerant leak detection sensor 81 may be supported by and fixed to the housing 50 and the like via supporting members, not shown, or may be suspended from the electrical box 71 via only the wire 82 without being particularly supported and fixed.

Hereinabove, the present embodiment has been described with reference to the drawings as appropriate, but the present embodiment is not limited thereto. For example, above-referenced examples may optionally be combined with one another.

In addition, in the above-described examples, those configurations have mainly been described in which the refrigerant leak detection sensors 81 are installed below the fittings 37, 38, and 39 and below the housing 50. However, the refrigerant leak detection sensors 81 may be installed anywhere outside of the housing 50. That is, since the refrigerant is heavier than the air as explained above, the refrigerant leak detection sensors 81 are preferably installed below the fittings 37, 38, and 39 and below the housing 50. However, since the refrigerant indicates characteristics completely different from those of the air, even if leak amount of the refrigerant is very little, the refrigerant leak detection sensors 81 can detect leaked refrigerant. Therefore, for example, even if the refrigerant leak detection sensors 81 are installed above the housing 50 or even if the refrigerant leak detection sensors 81 are installed above the fittings 37, 38, and 39, the refrigerant leak detection sensors 81 can detect leaked refrigerant.

Further, for example, the number of the installed refrigerant leak detection sensors 81 is not limited to the above-described examples either, and can be increased or decreased as appropriate.

Furthermore, for example, specific configuration of the refrigerant leak detection sensor 81 is not particularly limited either, and any refrigerant leak detection sensor, such as a commercially available sensor, can be used as long as the sensor is capable of detecting refrigerant.

Moreover, for example, in the embodiment shown in above-referenced FIGS. 6 and 7, one refrigerant detection sensor 81 is installed below the fitting 37 and one refrigerant leak detection sensor 81 is installed below the fitting 39. However, from the viewpoint of more reliable detection, three refrigerant leak detection sensors 81 in total may be installed respectively below the fittings 37, 38, and 39. In contrast, either one of the refrigerant leak detection sensor 81 installed below the fitting 37 or the refrigerant leak detection sensor 81 installed below the fitting 39 may be omitted. Alternatively, the refrigerant leak detection sensors 81 need not be installed below the fittings 37, 38, and 39 as long as the refrigerant leak detection sensors 81 are installed in the vicinities of the fittings 37, 38, and 39. Therefore, the refrigerant leak detection sensors 81 are preferably installed in the vicinity of at least one of the fittings 37, 38, and 39, and more preferably installed below the fittings 37, 38, and 39.

Still moreover, for example, all of the fittings 37, 38, and 39 are eligible for flare connection. However, all of the fittings 37, 38, and 39 need not always be eligible for flare connection, and the fittings 37, 38, and 39 may be changed as appropriate according to such as construction conditions. If the fittings 37, 38, and 39 are changed in this way, the refrigerant leak detection sensors 81 are preferably installed in the vicinities of the fittings eligible for flare connection.

Still moreover, for example, concerning the term "below" such as "below the fittings 37, 38, and 39" and "below the housing 50," the term "below" herein does not need to be strictly "right under" and the refrigerant leak detection sensor 81 may be installed anywhere as long as "lower than" the subject matter. Specifically, taking installation in FIG. 6 or 7 for example, the refrigerant leak detection sensor 81 is not installed "right under" the fitting 38. However, the refrigerant leak detection sensor 81 installed right under the fitting 37 is installed, in other words, on "the front side and the lower side" (i.e., lower right on the paper surface) as viewed from the fitting 38. Therefore, in such a configuration, one could argue that the refrigerant leak detection sensor 81 is installed "below" the fitting 38.

Still moreover, taking the configuration in above-referenced FIG. 8 or 9 for example, the refrigerant leak detection sensor 81 is installed in the vicinity of the center of the bottom surface of the housing 50 (i.e., installed right below the housing 50). However, one could argue that the refrigerant leak detection sensor 81 is installed below the fittings 37, 38, and 39 and the housing 50 as long as the refrigerant leak detection sensor 81 is installed right below the housing 50, even if not in the vicinity of the center of the bottom surface thereof. Additionally, as long as the refrigerant leak detection sensor 81 is installed at a point away from the bottom surface of the housing 50, that is, a point located lower than the bottom surface of the housing 50 in the height direction, one could argue that the refrigerant leak detection sensor 81 is installed "below" the fittings 37, 38, and 39 and the housing 50 even if at a point visible from above as viewed from above.

The invention claimed is:

1. A cooling/heating switching unit for connection with two or more use-side units and a heat-source-side unit to constitute an air conditioner, the two or more use-side units being independently operable to perform cooling and heating simultaneously, the cooling/heating switching unit comprising:

a first-refrigerant-pipe fitting and a second-refrigerant-pipe fitting that have a first refrigerant pipe and a second refrigerant pipe connected thereto, respectively, wherein the first and second refrigerant pipes are linked to the heat-source-side unit;

a third-refrigerant-pipe fitting that has a third refrigerant pipe connected thereto, wherein the third refrigerant pipe is linked to the use-side unit;

a first expansion valve and a second expansion valve that are configured to control a flow direction of refrigerant from either the first-refrigerant-pipe fitting or the second-refrigerant-pipe fitting to the third-refrigerant-pipe fitting, via a fourth refrigerant pipe, based on a combination of an open state or a closed state of the first expansion valve and the second expansion valve;

a housing that houses at least a part of the fourth refrigerant pipe; and a refrigerant leak detection sensor that is disposed outside of the housing to detect leaked refrigerant.

2. The cooling/heating switching unit according to claim 1, further comprising additional refrigerant leak detection sensors that are respectively disposed below the first-refrigerant-pipe fitting, the second-refrigerant-pipe fitting, and the third-refrigerant-pipe-fitting.

3. The cooling/heating switching unit according to claim 1, wherein at least one of the first-refrigerant-pipe fitting, the second-refrigerant-pipe fitting, and the third-refrigerant-pipe fitting are flare connected to the respective first refrigerant pipe, the second refrigerant pipe, and the third refrigerant pipe.

4. The cooling/heating switching unit according to claim 1, wherein the refrigerant leak detection sensor is disposed below the housing.

5. The cooling/heating switching unit according to claim 1, wherein the refrigerant leak detection sensor is connected, via an electric signal line for electrical connection, to a circuit board included in the cooling/heating switching unit, and the length of the electric signal line is one that allows the refrigerant leak detection sensor to be moved to a point below the housing.

6. The cooling/heating switching unit according to claim 5, wherein the length of the electric signal line is equal to or longer than the length obtained by adding 50 mm to the distance from the circuit board to a bottom surface of the housing.

7. The cooling/heating switching unit according to claim 1, wherein the refrigerant leak detection sensor is connected, via an electric signal line which is electrically connected to a circuit board included in the cooling/heating switching unit, and wherein the circuit board includes at least one of a buzzer that emits sound when a leak of refrigerant is detected by the refrigerant leak detection sensor and a light-emitting diode (LED) that emits light when a leak of refrigerant is detected by the refrigerant detection sensor.

8. An air conditioner comprising:

two or more use-side units being independently operable to perform cooling and heating simultaneously;

a heat-source-side unit that are used to form a refrigeration cycle between the heat-source-side unit and the two or more use-side units;

a first-refrigerant-pipe fitting and a second-refrigerant-pipe fitting that have a first refrigerant pipe and a second refrigerant pipe connected thereto, respectively, wherein the first and second refrigerant pipes are linked to the heat-source-side unit;

a third-refrigerant-pipe fitting that has a third refrigerant pipe connected thereto, wherein the third refrigerant pipe is linked to the use-side unit;

a first expansion valve and a second expansion valve that are configured to control a flow direction of refrigerant from either the first-refrigerant-pipe fitting or the second-refrigerant-pipe fitting to the third-refrigerant-pipe fitting, via a fourth refrigerant pipe, based on a combination of an open state or a closed state of the first expansion valve and the second expansion valve;

a housing that houses at least a part of the fourth refrigerant pipe; and a refrigerant leak detection sensor that is disposed outside of the housing to detect leaked refrigerant.

* * * * *